United States Patent [19]

Wu et al.

[11] Patent Number: 4,927,199

[45] Date of Patent: May 22, 1990

[54] LATCH ASSEMBLY FOR CYLINDER LOCK

[76] Inventors: Rong-Faa Wu; Shoei-Jyi Wu, both of No. 82, Lane 17, Ho-Mu Tsun, Chung-Pu Hsiang, Chiayi Hsien, Taiwan

[21] Appl. No.: 249,359

[22] Filed: Sep. 23, 1988

[51] Int. Cl.[5] ..... E05B 9/02

[52] U.S. Cl. ..... 292/337; 292/DIG. 60; 292/DIG. 74

[58] Field of Search ..... 292/337, DIG. 60, 169, 292/169.21, 169.22, 169.23, 169.16, DIG. 74

[56] References Cited

U.S. PATENT DOCUMENTS

| | | | |
|---|---|---|---|
| 48,297 | 6/1865 | McGonnigle | 292/169.22 |
| 1,707,413 | 4/1929 | Pendleton | 292/337 |
| 3,767,241 | 10/1973 | Orr | 292/337 X |
| 4,564,229 | 1/1986 | Mullich et al. | 292/337 X |
| 4,602,490 | 7/1986 | Glass et al. | 292/337 X |
| 4,615,549 | 10/1986 | Couture | 292/337 X |
| 4,687,239 | 8/1987 | Lin | 292/337 X |
| 4,711,477 | 12/1987 | Fann et al. | 292/337 X |
| 4,834,432 | 5/1989 | Smallegan et al. | 292/DIG. 60 X |

FOREIGN PATENT DOCUMENTS

| | | | |
|---|---|---|---|
| 165719 | 4/1950 | Fed. Rep. of Germany | 292/169.15 |
| 293531 | 2/1932 | Italy | 292/337 |

*Primary Examiner*—Lloyd A. Gall
*Attorney, Agent, or Firm*—Ladas & Parry

[57] ABSTRACT

A dual backset latch bolt assembly includes at least one pair of cam members mounted on at least one side plate of a latch housing. The latch bolt assembly is provided with positioning holes and engaging notches so that the assembly can be used in combination with a lock having either positioning female screws or guide plates for attachment. The latch bolt assembly may be arranged such that two pairs of cam members are mounted respectively on two side plates of the housing, thereby permitting the latch assembly to cooperate with a lock having either a single rotary spindle or two rotary spindles which are respectively associated with two parts of the lock operable from the outside and inside of a door.

3 Claims, 8 Drawing Sheets

LATCH ASSEMBLY FOR CYLINDER LOCK

BACKGROUND OF THE INVENTION

This invention relates to a dual backset latch assembly for a cylinder lock, and particularly to an improvement in a dual backset latch assembly which includes two cam members to cooperate with a transmission plate so as to transmit the movement of the spindle of a cylinder lock to a bolt.

Latch assemblies which are adjustable between two backset measurements are available for cylinder locks in the art. These latch assemblies are operable by a spindle of a lock having two knobs respectively provided at the inside and outside of a door. U.S. Pat. No. 4,615,549 discloses a dual backset latch which includes two intersecting cam members which operate about two separate and parallel axes which are the centers of the two spindle backset in common industry usage. In this latch construction, the two cam members are respectively mounted on two side plates of the housing of the latch assembly so as to avoid the interaction of the two cam members during operation. The configuration of the two cam members does not permit the cam members to be mounted on the same side plate of the housing of the latch because one of the two intersecting cam members would obstruct the other when the other is in operation. Since only a pair of cam members can be provided in the latch assembly disclosed in this patent, the latch assembly can cooperate with a lock having a single spindle, but cannot combine with a known lock which has two rotating spindles one of which is operated from the outside of a door and the other of which is operated from the inside of the door.

In addition, the latch assembly described in the U.S. Patent has a disadvantage in that the latch assembly cannot be used in combination with any one of conventional cylinder locks which commonly have two female screws B2 to be secured to the housing of a latch assembly shown in FIG. 1, and is only applicable for a particular cylinder lock having guide plates X which can engage with the housing of the latch assembly shown in FIGS. 1 and 2 and which can be used for the purposes of rigidly connecting the latch assembly to the cylinder lock. This is because no securing hole can be provided in the latch assembly described in the U.S. Patent.

SUMMARY OF THE INVENTION

An object of the invention is to provide a dual backset latch assembly which can be used in combination with a cylinder lock of the type shown in either FIGS. 1 or 2.

Another object of the invention is to provide a dual backset latch assembly having two latch operating mechanisms to cooperate with a lock assembly having two rotating spindles, one being associated with the part of the lock which must be operated from the outside of a door and the other being associated with the part of the lock which must be operated from the inside of the door.

According to the present invention, a dual backset latch bolt assembly includes intersecting first and second cam members each of which has a disc member and a journal boss to be journalled in a cam guide slot provided in a side plate of the housing of a latch bolt assembly. The first cam member has a recess adjacent to the second cam member so as to receive a portion of the second cam member, thereby permitting the second cam member to overlap the first cam member. The axial dimension of the first journal boss is greater than that of the second boss so that the first boss can be inserted into the cam guide slot without interference with the second boss. A transmission plate is provided for engagement with the cam members and a latch bolt so as to transmit the movement of the spindle of a lock to the latch bolt. Aligned positioning holes are provided in two parallel side plates of the housing of the latch assembly to receive elongated female screws B2 of the lock shown in FIG. 1. An elongated axial opening is provided in the rear portion of the transmission plate and aligned with the positioning holes so that the female screws are permitted to be threaded through the housing of the latch assembly. Engaging notches are provided in the side plates of the latch housing for the purposes of engagement with the guide plate X of the lock shown in FIG. 2. The provision of the positioning holes and the engaging notches in the side plates of the housing enable the latch assembly of the invention to combine with the lock either shown in FIG. 1 or 2.

According to one aspect of the invention, the latch assembly is provided with two pairs of cam members each pair of which is mounted on each side plate of the latch housing. The two pairs of cam members can cooperate respectively with two rotating spindles of a lock.

The presently preferred embodiments of the present invention will be described in detail with reference to the accompanying drawings, in which:

DETAILED DESCRIPTION OF THE PREFERRED EMBODIMENTS

Figure 4:
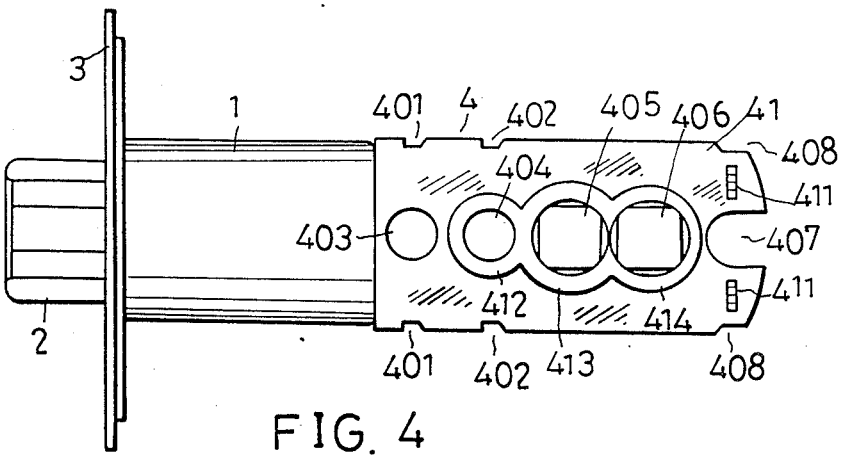
FIG. 4 is a side elevation view of a first embodiment of the latch assembly according to the present invention.
Figure 5:
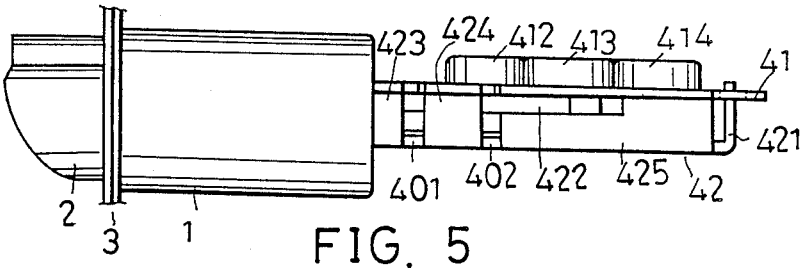
FIG. 5 is a top view of the latch assembly of FIG. 4.
Figure 6:
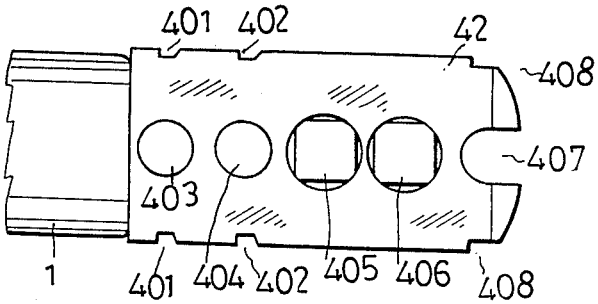
FIG. 6 is another side elevation view of the latch assembly of FIG. 4.

Referring to FIGS. 4, 5 and 6, a first preferred embodiment of the present invention is shown, including a latch bolt housing 1 and a bolt 2 provided in the housing 1. The latch bolt housing 1 can be mounted near an edge of a door and has a first mounting plate 3 flush with the door edge. The bolt 2 can extend out of the housing 1 and retract fully into the housing 1 by means of a mechanism which will be described hereinafter.

Figure 7:
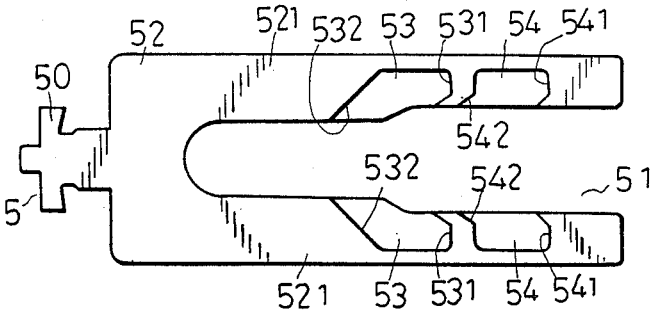
FIG. 7 is a plan view of the transmission plate.
Figure 8:
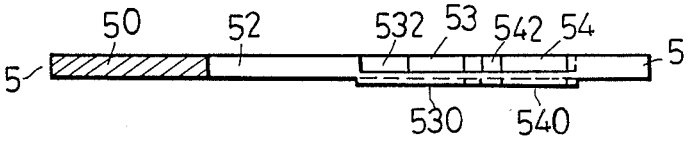
FIG. 8 is a side elevation view of the transmission plate.
Figure 9:
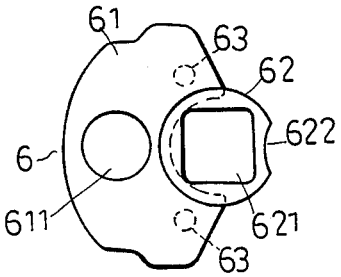
FIGS. 9 and 10 show a first cam member.
Figure 11:
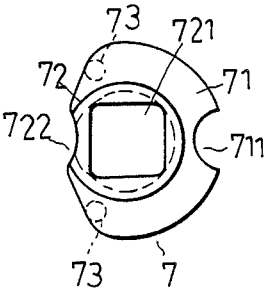
FIGS. 11 and 12 show a second cam member.
Figure 10:
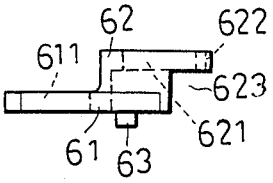
Figure 12:
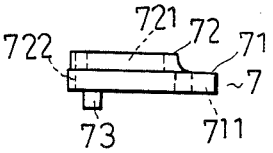
Figure 13:
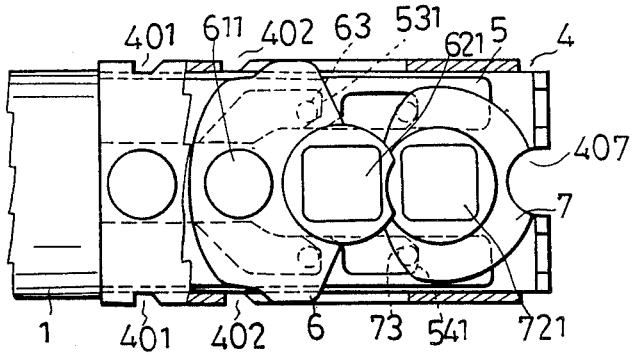
FIG. 13 is a sectional plan view of the latch assembly of FIG. 4.
Figure 14:
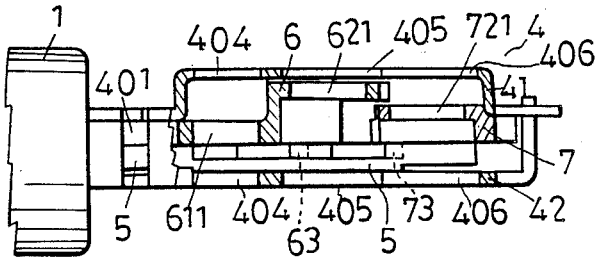
FIG. 14 is a sectional elevational view of the latch assembly.

At a rear side of the housing 1 is an extension housing 4 which includes two spaced apart parallel side plates 41 and 42 which are connected to one another so as to confine a chamber. The side plate 42 has tabs 423, 424 and 425 which are bent at the top and bottom sides of the plate 42 and connected to the other side plate 41. An elongated opening 422 is formed at the top and bottom of housing 4. The front ends of the plates 41 and 42 extend into and are positioned in the case 1. The rear end 421 of the plate 42 is forked, bent toward the plate 41, and engaged in slots 411 of the rear portion of the plates 41. At two sides of the front portion of the plates 41 and 42 are engaging notches 401 and 402 which are aligned respectively. Aligned positioning holes 403 and 404 and aligned cam guide slots 405 and 406 are provided in the plates 41 and 42. The cam guide slots 405 and 406 and the positioning hole 404 of the plate 41 are provided respectively with flanges 413, 414 and 412. There are also rear engaging notches 407 and 408 in the plates 41 and 42. The space confined by the plates 41 and 42 accommodates three elements, i.e. a transmission plate 5 shown in FIGS. 7 and 8, a front cam shown in FIGS. 9 and 10, and a rear cam 7 shown in FIGS. 11 and 12. The front and rear cams 6 and 7 are mounted on the side plate 41 and can be selectively connected to the spindle of a cylinder lock so as to create a desired backset. The cam 6 or 7 transmits the movement of the spindle to the transmission plate 5 which operates the latch bolt 2 and provides two backset measurements which are respectively 60 mm. and 70 mm.

The transmission plate 5 is provided adjacent to the side plate 42 and is a generally oblong plate which has at its front end an engaging member 50 extending into the case 1 and engaging with the bolt 2. An axial oblong opening 51 is provided in the rear portion 52 of the plate 5 to divide the rear portion 52 into two substantially parallel strips 521 having inner sides defining opening 51. The axial opening 51 is in alignment with the cam guide slots and the positioning holes. At one side of each strip 521 are provided indentations 53 and 54.

The cam 6 includes a disc 61 adjacent to the transmission plate 5 and a substantially circular journal boss 62 inserted rotatably in the cam guide slot 405 of the plate 41. The disc 61 has two camming protrusion 63 extending into the indentations 53 of the plate 5, and a hole 611 to be in alignment with the positioning holes 404 of the plates 41 and 42. The journal boss 62 has a rectangular spindle slot 621 for receiving the spindle of a lock, and a cut-out portion 622.

The cam 7 has a disc 71 and a journal boss 72 inserted rotatably in the cam guide slot 406 of the plate 41. A rectangular spindle slot 721 extends from the disc 71 to the journal boss 72. Two camming protrusions 73 are provided on the disc 71 at the side opposite to the journal boss 72 and are placed so that they extend into the indentations 54. The cam member 6 has a concavity 623 defining a recess adjacent to the cam member 7 so as to receive a portion of the cam member 7, thereby permitting the cam member 7 to overlap the cam member 6. The axial dimension of the journal boss 62 is greater than that of the journal boss 72 so that the journal boss 62 has a portion which is inserted into the cam guide slot 405 without interference with the journal boss 72.

Figure 1:
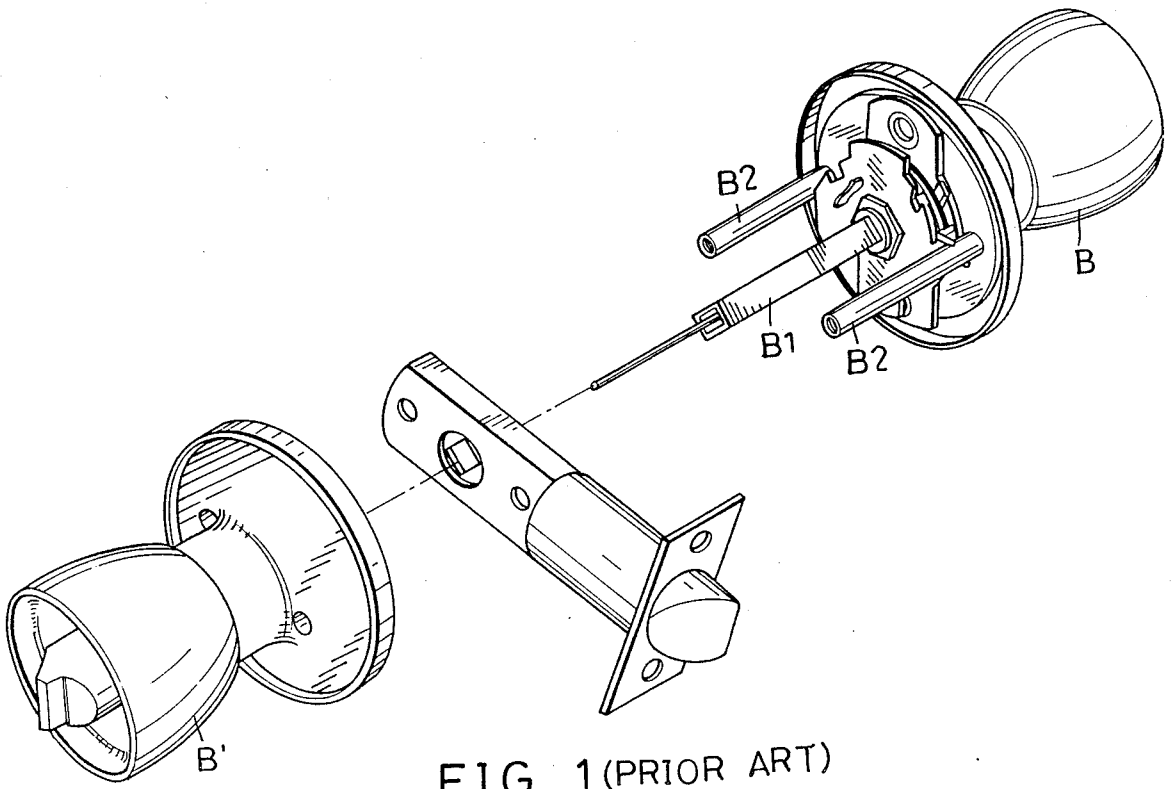
FIG. 1 (PRIOR ART)
FIG. 1 is a perspective view showing a known lock in combination with a latch assembly.
Figure 2:
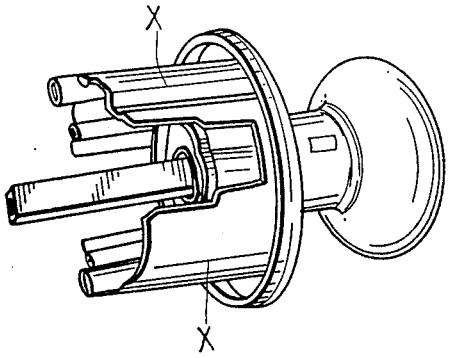
FIG. 2 (PRIOR ART)
FIGS. 2 and 3 show another known lock in combination with a latch assembly.
Figure 3:
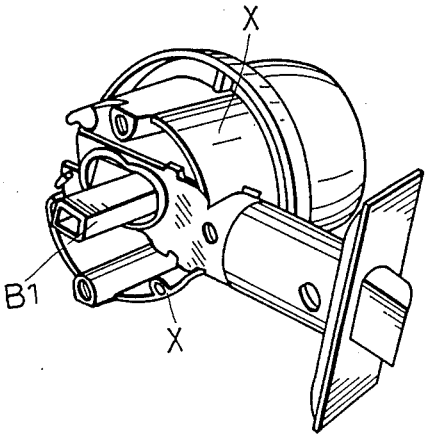
FIG. 3 (PRIOR ART)
Figure 15:
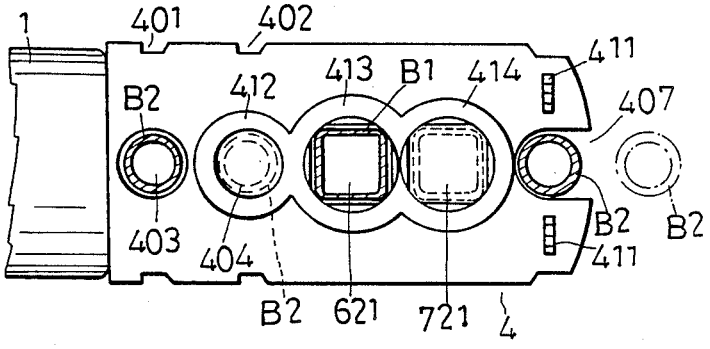
FIG. 15 shows how the latch assembly is connected to the lock shown in FIG. 1.

The latch assembly of the invention can be mounted on a door in combination with the cylinder lock shown in either FIG. 1 or 2. As shown in FIG. 15, when the latch assembly of the present invention is combined with the lock B of FIG. 1, the spindle B1 of the lock B is inserted into the spindle slot 621 and female screws B2 of the lock B are threaded through the positioning hole 403 and the notch 407, thereby connecting the lock to the latch assembly of the invention. If the spindle of the lock B is inserted into the spindle slot 721, one of the female screws B2 is threaded through the positioning hole 404 and the other is left free as shown in phantom lines.

Figure 16:
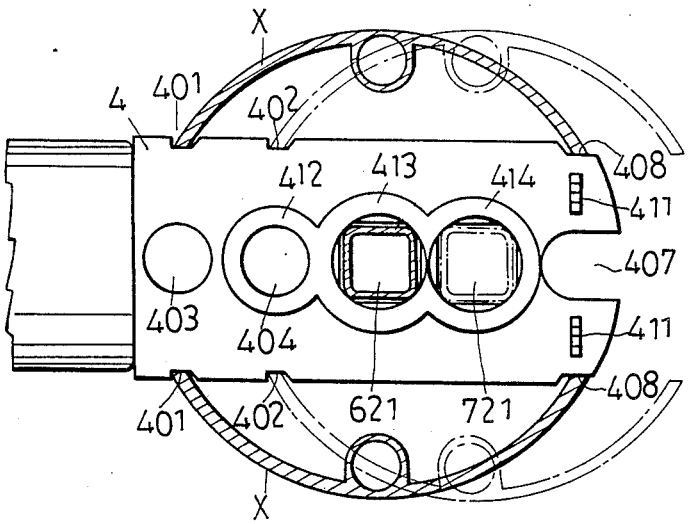
FIG. 16 shows how the latch assembly is connected to the lock shown in FIG. 2.

FIG. 16 shows how the latch assembly of this invention is combined with the lock of FIG. 2. Clamp plates X of the lock are caused to engage with the engaging notches 401 and 408 of the side plates 41 and 42 when the spindle of the lock is inserted in the spindle slot 621 (shown in solid lines) and engage only with the engaging notches 402 when the spindle is inserted into the spindle slot 721 (shown in phantom lines).

Figure 17:
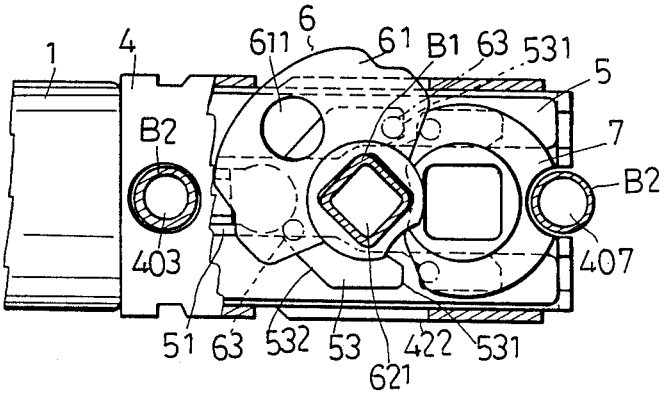
FIGS. 17 and 18 illustrates the operation of the latch assembly of the invention.
Figure 18:
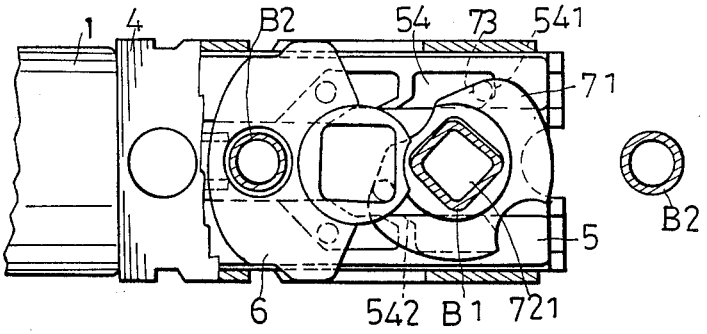
Figure 19:
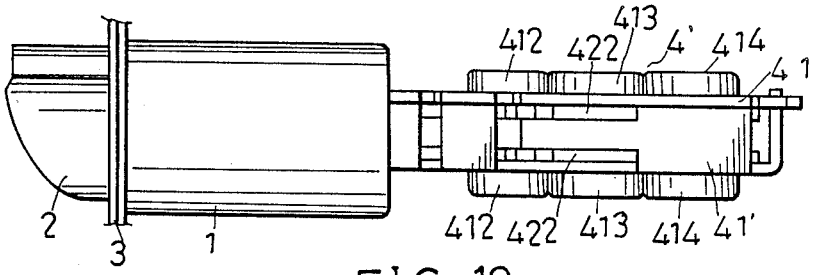
FIGS. 19 and 23 show another embodiment of the present invention.

The operation of the latch assembly of the invention is illustrated in FIGS. 17 and 18. When the cam 6 is turned clockwise by the spindle of a lock, one of the camming pins 63 pushes rearward the face 531 of one of the indentation 53, thereby also moving the plate 5 rearward and retracting the latch bolt 2 (see FIG. 17). When the cam 7 is turned clockwise by the spindle of a lock, one of the camming pins 73 of the cam 7 pushes rearward the face 541 of the indentation 54, thereby moving rearward the plate 5 and retracting the latch bolt 2 (see FIG. 18).

FIGS. 19 to 23 show a second embodiment of the latch assembly of the present invention wherein elements identical to those of the previous embodiment are represented by identical reference numerals. The second embodiment is adapted to combine with a lock which has two spindles respectively on two opposite sides of the latch assembly.

The second embodiment of the latch assembly includes an extension housing 4′ which has two parallel side plates 41 and 41′ both having two intersection cam guide slots 405 and 406. The side plate 41′ has tab portions bent towards and connected to the plate 41, as in the previous embodiment. On both parallel side plates 41, 41′ are mounted cam members 6 and 7.

A transmission plate 5′ is provided between cam members 6 and between cam members 7. The transmission plate 5′ is substantially similar to the transmission plate 5 except that the plate 5′ has indentations 53 and 54 defining recesses at two opposite planar sides of each strip member 521 to receive the camming pins 63 and 73.

Figure 23:
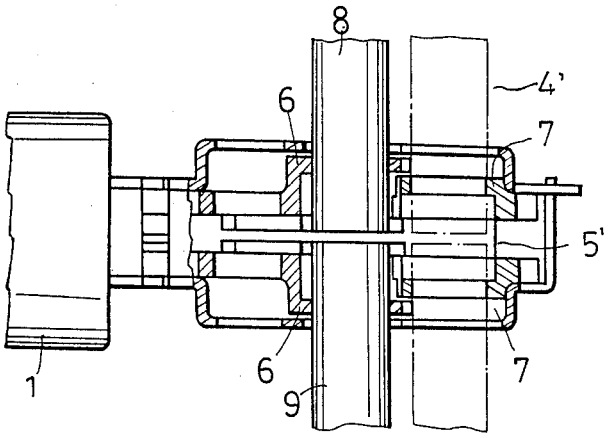
Figure 20:
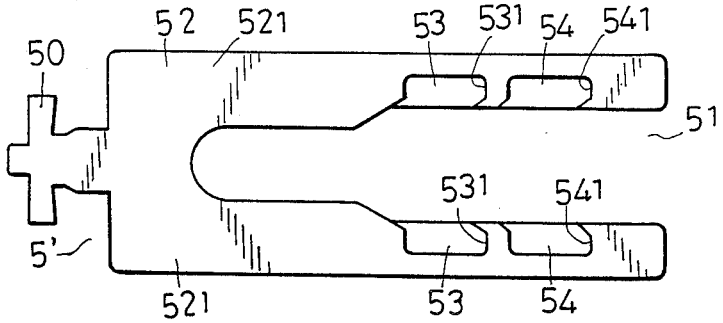
Figure 21:
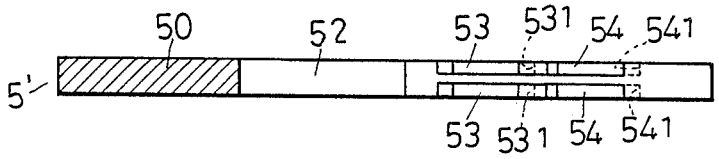
Figure 22:
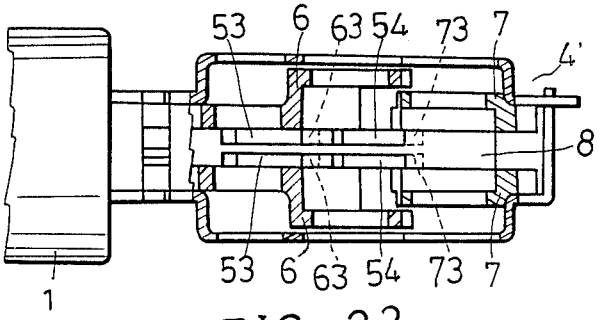

The operation of this embodiment of the latch assembly is substantially similar to that of the previous embodiment except that the cam members 6 and 7 mounted on two side plates of this embodiment can cooperate with two spindles 8 and 9 as shown in FIG. 23.

With the invention thus explained, it is apparent that numerous modifications and variations can be made without departing from the scope of the invention. It is therefore intended that the invention be limited as indicated only in the appended claims.

What I claim is:

1. A dual backset latch assembly to be associated with a lock having a latch operating spindle, said latch assembly having a latch housing and an extension housing, said extension housing having two parallel side walls at least one of which has a cam guide slot means, a latch bolt provided in said latch housing for moving to a locking position or an unlocking position upon rotation of said spindle and a transmission mechanism for transmitting the movement of said latch operating spindle to said latch bolt when said lock is operated, said transmission mechanism including a first and a second cam member for rotation about two parallelly offset transverse axes which are selectable for the axis of rotation of said spindle, said first cam member having a first disc, and a substantially circular first journal boss axially projecting from said first disc, said second cam member having a second disc and a substantially circular second journal boss axially projecting from said second disc, said first and second journal bosses being inserted rotatably in said cam guide slot means and having a spindle slot for receiving said spindle, and a transmission plate to transmit the movement of said first or second cam member to said latch bolt, said latch assembly having improvements wherein both said first and second cam members are mounted on one of said parallel side walls through said cam guide slot means, the total axial length of said first cam member being greater than that of said second cam member, said first cam member being concaved radially inward to form a recess adjacent to said second cam member, said recess having an axial length smaller than said total axial length of said first cam member but greater than that of said second cam member, thereby permitting said second cam member to overlap said first cam member, said transmission plate being placed adjacent to said first and second cam members, and having a front engaging end to engage with said latch bolt, and a rear portion which has a longitudinally extending opening dividing said rear portion into two parallel strip members, said opening being aligned with said cam guide slot means, said strip members having inner sides opposite to one another, each of said strip members having a first and a second indentation adjacent to said inner sides, said first disc having two camming pins respectively extending into said first indentation of said strip members, said second disc having two camming pins extending into said second indentation of said strip members.

2. A dual backset latch assembly as claimed in claim 1, wherein said parallel side walls of said extension housing are provided with aligned positioning holes, said longitudinally extending opening of said transmission plate being elongated so as to be in alignment with all of said positioning holes.

3. A dual backset latch assembly to be associated with a lock having two latch operating spindles, said latch assembly having a latch housing and an extension housing, said extension housing having two parallel side walls having a cam guide slot means, a latch bolt provided in said latch housing for moving to a locking position or an unlocking position upon rotation of said latch operating spindles, and a transmission mechanism for transmitting the movement of said spindles to said latch bolt when said lock is operated, said transmission mechanism having a plurality of cam members mounted on said parallel side walls for rotation about parallelly offset transverse axes which are selectable for the axis of rotation of said spindles, and a transmission plate for transmitting the movement of said cam members to said latch bolt, said latch assembly having improvements wherein both said parallel side walls bear said cam guide slot means, said cam guide slot means includes a first cam guide slot and a second cam guide slot in each of said parallel side walls, said cam members including a first cam member and a second cam member mounted on each of said parallel side walls to cooperate with each of said spindles of said lock, each of said first cam members having a first disc, and a substantially circular first journal boss, each of said second cam members having a second disc and a substantially circular second journal boss formed on said second disc, said first and second journal bosses being respectively inserted in said first and second cam guide slots and having a spindle slot for receiving said spindle, each of said first cam members having a recess adjacent to each of said second cam members for receiving a portion of each of said second bosses, thereby permitting each of said second cam members to overlap each of said first cam members, the axial dimension of said first bosses being greater that that of said second bosses so that each of said first bosses has a portion which extends into each of said first cam guide slots without interference with each of said second bosses, said transmission plate being sandwiched between said first discs and between said second discs, and having a front engaging end to engage with said latch bolt and a rear portion which has a longitudinally extending opening dividing said rear portion into two parallel strip members, said opening being aligned with said first and second cam guide slots, said strip members having inner sides opposite to one another, each of said strip members having two opposite recessed planar sides, each of said recessed planar sides having a first and a second indentation adjacent to said inner sides, each of said first discs having two camming pins respectively extending into each of said first indentations of said strip members, each of said second discs having two camming pins extending into each of said second indentations of said strip members.

* * * * *